US006845584B2

(12) United States Patent
Vincent

(10) Patent No.: US 6,845,584 B2
(45) Date of Patent: Jan. 25, 2005

(54) PICTORIAL DISPLAY

(75) Inventor: Thomas Vincent, San Rafael, CA (US)

(73) Assignee: Umbra, Inc., Buffalo, NY (US)

( * ) Notice: Subject to any disclaimer, the term of this patent is extended or adjusted under 35 U.S.C. 154(b) by 19 days.

(21) Appl. No.: 09/868,836

(22) PCT Filed: Dec. 15, 2000

(86) PCT No.: PCT/US00/34161

§ 371 (c)(1),
(2), (4) Date: Jun. 21, 2001

(87) PCT Pub. No.: WO01/43601

PCT Pub. Date: Jun. 21, 2001

(65) Prior Publication Data

US 2002/0133994 A1 Sep. 26, 2002

(51) Int. Cl.[7] ..... A47G 1/06
(52) U.S. Cl. ..... 40/720; 40/743
(58) Field of Search ..... 40/720, 743, 761, 40/768, 771, 777, 661, 358, 800; D6/301, 314

(56) References Cited

U.S. PATENT DOCUMENTS

| | | | |
|---|---|---|---|
| 470,222 | A | 3/1842 | Townsend |
| 1,465,353 | A | 5/1922 | Donaldson |
| 1,729,961 | A | 10/1929 | Partridge |
| 2,572,454 | A | 10/1951 | Down et al. |
| 3,291,435 | A | 12/1966 | Herr |
| 3,364,603 | A | 1/1968 | Tate, Jr. |
| 3,561,146 | A | 2/1971 | Dembar |
| 3,596,391 | A | 8/1971 | Knight, Jr. |
| 3,658,413 | A | 4/1972 | Cornell |
| 3,703,045 | A | 11/1972 | Nyman |
| 3,774,332 | A | 11/1973 | Schneider |
| 4,196,535 | A | 4/1980 | Heimo |
| 4,268,985 | A | 5/1981 | Lecznar |
| 4,901,456 | A | 2/1990 | Cotutsca |
| 4,930,235 | A | 6/1990 | Gillen et al. |
| 4,991,328 | A | 2/1991 | Rousseau et al. |
| 5,226,252 | A | 7/1993 | Haluska |
| D364,278 | S | 11/1995 | Guyton |
| D375,207 | S | 11/1996 | Pempek |
| D406,699 | S | 3/1999 | Mullen |
| D227,001 | S | 5/2001 | Dembar |

*Primary Examiner*—Brian K. Green
(74) *Attorney, Agent, or Firm*—Saidman DesignLaw Group

(57) ABSTRACT

A pictorial display resides in the combination of a transparent polyhedron and an opaque backing. The backing is removably attached to the polyhedron block by interlocking elements formed on the backing co-acting with recesses formed in appropriate surfaces of the polyhedron block. Pictures placed between the block and backing are dramatically viewed through the block.

32 Claims, 9 Drawing Sheets

PICTORIAL DISPLAY

CROSS-REFERENCE TO RELATED APPLICATION

This application is a 371 of PCT/US00/34161, filed Dec. 15, 2000, which is a continuation of our prior abandoned application Ser. No. 09/461,593, filed Dec. 15, 1999 now abandoned.

TECHNICAL FIELD

This invention relates to an apparatus for displaying pictures, photographs, prints, and other pictorial or artistic representations (hereafter, generically referred to as pictures).

BACKGROUND ART

Picture display devices in the form of cubes and other polyhedrons have been the subject of inventive activity in the past. Representative samples of prior art patents include the following.

U.S. Pat. No. 470,222 to Townsend discloses a paper weight comprising a transparent slab that rests within a recess formed in a frame. Pictures can be displayed by placing them between the slab and frame. The frame includes a pair of springs that are biased against small recesses formed in the slab. Such springs are intended to prevent relative lateral movement between the slab and the frame. However, it is clear from the disclosure of Townsend that gravity, not the springs provides the primary means by which the slab remains seated in the frame. Thus, the slab would easily separate from the frame and come crashing to the floor if the paper weight was rotated 90 degrees, or inverted.

U.S. Pat. No. 2,572,454 to Down et al. discloses a transparent cube with a shallow, blind recess formed in each face, a photograph fit into each of the blind recesses, and a transparent plug pressed into and closing each recess. The cube is then rotatably supported at opposite corners on a display stand. Once a selection of pictures has been made and sealed in the cube, the pictures cannot thereafter be replaced.

U.S. Pat. No. 3,364,603 to Tate, Jr. discloses a nameplate having an "advertising field" on the back of the nameplate. The advertising field includes a prism that slides or snaps into an extruded frame so that a calendar, advertising material, etc. can be sandwiched between the prism and frame, and therefore viewed from the rear of the nameplate. Tate, Jr.'s nameplate is designed for stationary use; tilting either end of the nameplate upwardly would cause the prism to slide out the opposite end of the frame.

U.S. Pat. No. 3,561,146 to Dembar shows a pictorial display apparatus in the form of a cube, a hexagon, or a truncated prism. The apparatus comprises a thin, transparent body having a plurality of sides defining a hollow interior which is filled with a resilient foam material of a shape that conforms to the shape of the hollow interior. A photo is placed behind each of the thin transparent sides and held in place by the resilient material. An opaque backing is located behind the photos as a backdrop. Dembar's display apparatus is thus constructed of many elements, each of which are relatively expensive to manufacture, and labor intensive to assemble.

U.S. Pat. No. 3,658,413 to Cornell discloses two embodiments of display devices. The first comprises a base, a support rotatably mounted on the base, and a transparent polyhedron resting on the support. The support has three square, planar surfaces joined along three contiguous edges to form an open, tri-faceted cavity sharing a common corner. A pin depends symmetrically relative to the planar surfaces from the common corner and is rotatably received within a mating cylindrical recess in the base permitting the support to rotate relative to the base. A picture or other planar object is supported on each of the surfaces of the cavity. A transparent cube is laid in the cavity with one corner of the cube fitting within the common corner. The pictures are viewed through the cube by looking through the surface of the cube which is opposite and parallel to the surface on which the photo is supported. The display device has a plurality of parts which fit together but are held in vertical alignment by gravitational forces. The display is not self-contained and cannot be easily moved or handled. An accidental blow thereto could send all parts flying in different directions. In the other embodiment, a 14-sided polyhedron includes an array of square and triangular surfaces formed on a transparent block. The patent is not clear as to whether the polyhedron is intended to rest in a similarly shaped, multi-faceted cavity, as in the first embodiment, or whether each photo is to be attached to a supporting surface to be seen through an opposite, viewing surface. If the former, the embodiment is subject to the same deficiencies as the first embodiment. If the latter, the photos are apparently secured to their respective surfaces by adhesives or the like, which exposes the photos to deterioration and/or destruction from direct contact with the outside world.

U.S. Pat. No. 3,703,045 to Nyman shows a pair of hollow shells in the shape of cubes, one of which fits contiguously within the other. At least the outer shell is transparent and has a removable, sliding side which allows access to its interior. Planar spaces are provided between the cubes for pictures. The structure is costly to make and appears to be relatively fragile in use.

As the foregoing suggests, one primary deficiency of the pictorial displays of prior art is that they are unstable when moved from a stationary, horizontal display surface.

DISCLOSURE OF THE INVENTION

The present invention overcomes the difficulties described above by providing a backing sheet attached to a transparent block of material shaped as a polyhedron with pictures located therebetween. The backing sheet is removably attached to the polyhedron block by attachment tabs formed on the backing sheet coacting with complementary attachment receptacles formed in appropriate surfaces of the polyhedron block. Pictures placed between the block and sheet are viewed through the block.

It is an object of the invention to provide a pictorial display which displays multiple pictures in a dramatic fashion.

It is a further object of the invention to provide a self-enclosed pictorial display which is easily handled and transported in an assembled state.

It is a further object of the invention to provide a self-enclosed pictorial display that is simple and economical to manufacture.

It is a further object of the invention to provide a self-enclosed pictorial display which is rugged.

It is a further object of the invention to provide a self-enclosed pictorial display which permits limited cropping of photographs for display.

It is a further object of the invention to provide a pictorial display comprising a transparent polyhedron with pictures displayed between selected surfaces of the polyhedron and an opaque backing sheet.

It is a further object of the invention to provide a pictorial display comprising a transparent hexahedron with pictures displayed between selected surfaces of the hexahedron and an opaque backing sheet.

It is a further object of the invention to provide a pictorial display comprising a transparent cube with pictures displayed between selected surfaces of the cube and an opaque backing sheet.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

MODES FOR CARRYING OUT THE INVENTION

Figure 1:
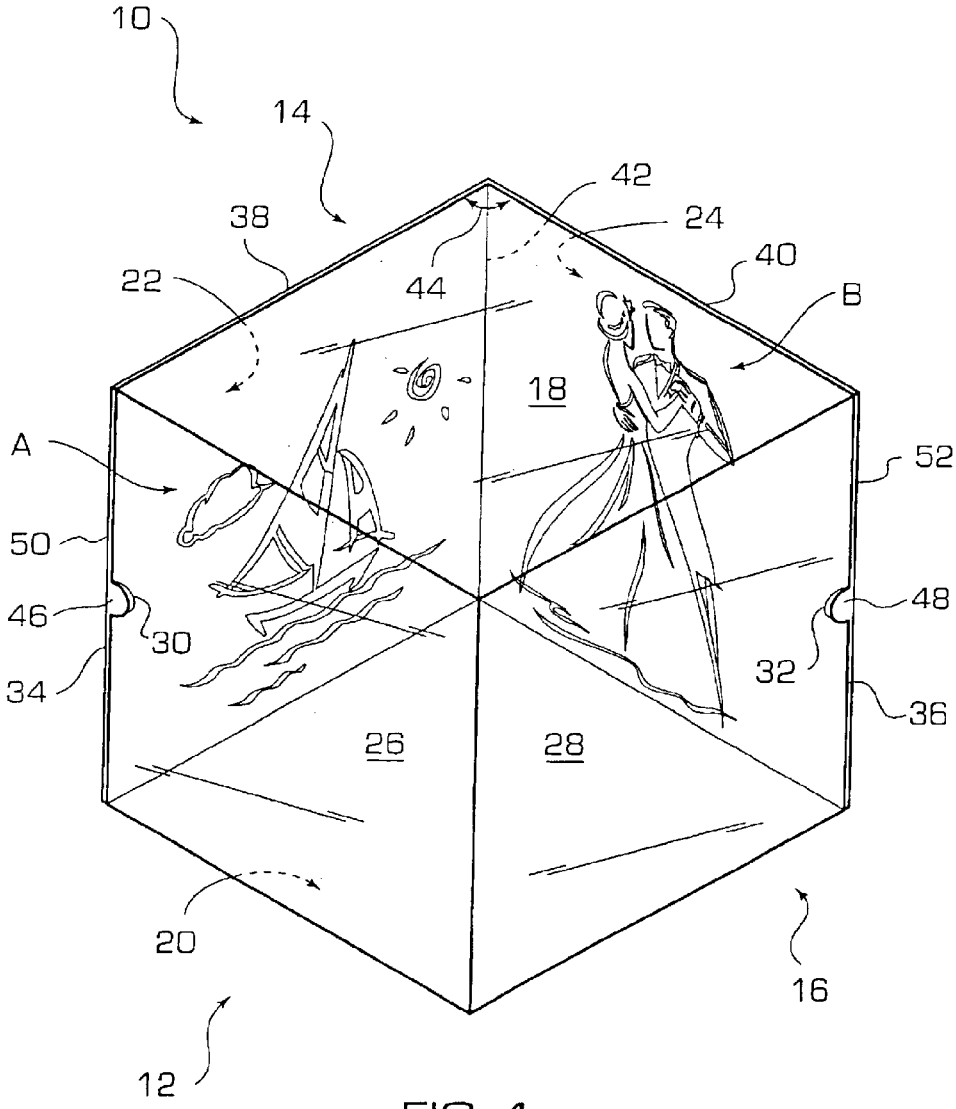
FIG. 1 is a perspective view which illustrates a preferred embodiment of the present invention shown displaying two pictures A and B.
Figure 2:
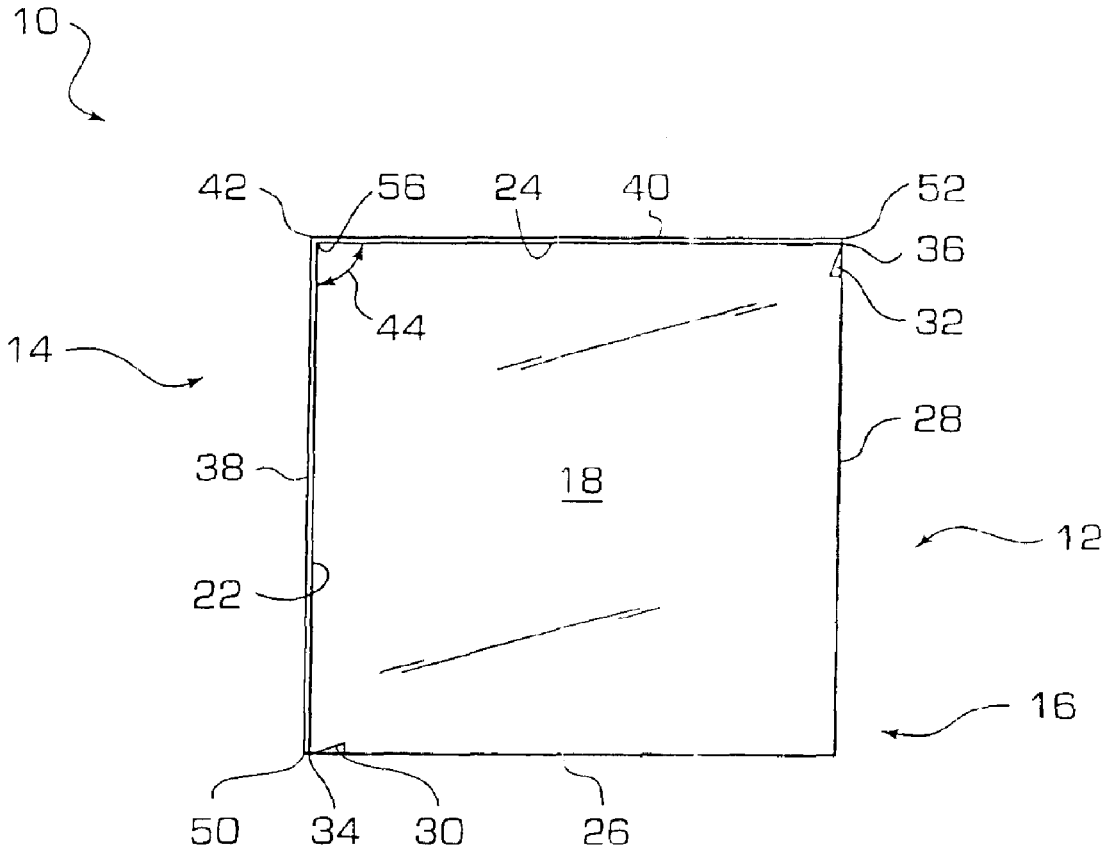
FIG. 2 is a top view of the invention of FIG. 1.
Figure 3:
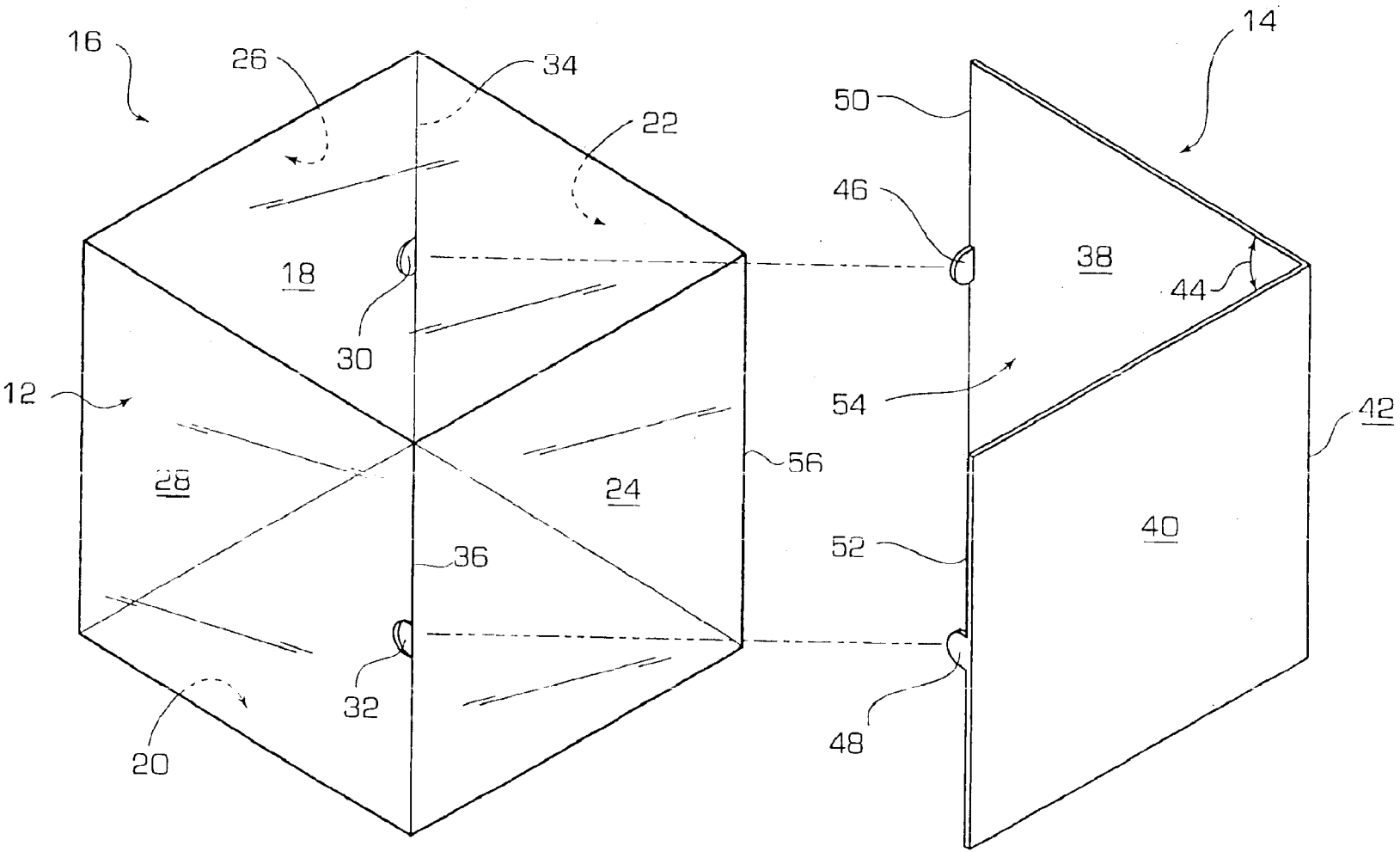
FIG. 3 is an exploded perspective view of the embodiment of FIG. 1 shown without any pictures.

Referring to FIGS. 1–3, a preferred embodiment of the inventive pictorial display 10 comprises a multi-faceted viewing screen 12 and an opaque backing 14.

Viewing screen 12 preferably comprises a solid block of transparent material in the shape of a cube 16. Cube 16 is preferably made of an acrylic plastic, although any suitable transparent or highly translucent material will suffice, including cellulose acetate, cellulose nitrate, polystyrene, or even glass, e.g., lead crystal.

Cube 16 has six external sides, each of which is characterized by a surface, said surfaces collectively comprise a top 18, a bottom 20, a pair of display surfaces 22 and 24, and a pair of viewing surfaces 26 and 28. Surfaces 18–28 are each square with identical dimensions and are preferably flat, although curved surfaces may be provided for unusual effects. Viewing surface 26 includes a recessed D-shaped notch 30 located, for aesthetic purposes, about midway between top 18 and bottom 20. Viewing surface 28 includes a similarly located D-shaped notch 32. Notches 30 and 32 slope inwardly from adjacent edges or corners 34 and 36, respectively, as seen more clearly in FIG. 2. Notches 30 and 32 are for a purpose to be described shortly.

Backing 14 is made from an opaque material, preferably a slightly flexible sheet of metal or plastic. Backing 14 is bent to form two square, planar portions 38 and 40 integrally joined along a common edge or corner 42 at the angle defined by the conjoining two sides of cube 16, in this example, sides 22 and 24 forming a right angle 44. Planar portions 38 and 40 are in this embodiment both square and of substantially the same dimensions as surfaces 18–28. A pair of D-shaped flanges or tabs 46 and 48 (not shown in FIG. 2 for clarity) extend inwardly from the free edges 50 and 52 of planar portions 38 and 40. Tabs 46 and 48 are bent slightly beyond orthogonally from the plane of portions 38 and 40, respectively, substantially at the same angle as the slope of recesses 30 and 32, and are preferably maintained at that angle by the spring constant of the material of backing 14. Flanges or tabs 46 and 48 constitute interlocking elements which attach backing 14 to cube 16. When attached to cube 16, the planar portions of backing 14 are in substantially parallel relationship with the confronting sides of cube 16.

Referring to FIG. 3, the manner of assembling pictorial display 10 will now be described. First, place individual, pre-cut pictures A and B (FIG. 1) on the interior surfaces of planar portions 38 and 40. Next, press cube 16 against backing 14 until convex corner 56 (FIG. 3) nests within concave corner 42. In the process of pressing corner 56 into corner 42, backing 14 will flex outwardly as tabs 46 and 48 cam over edges 34 and 36. Tabs 46 and 48 will snap into recesses 30 and 32 and cling thereto to releasably attach backing 14 to cube 16. Backing 14 will then be securely fastened to cube 16. In this preferred embodiment, the planar portions of backing 14 completely cover the corresponding sides of cube 16, so that when in place, backing 14 protects the pictures from abrasions due to contact with outside objects. Other sizes and designs are permissible, however. Also, backing 14 is sufficiently opaque that no light passes therethrough; consequently, no disparate images will bleed through pictures A or B to obscure the details thereof. To remove backing 14, simply flex, it outwardly until tabs 46 and 48 clear edges 34 and 36. Cube 16 and backing 14 will easily separate.

The visual effect of pictorial display 10 is quite dramatic. When looking through viewing surface 28 at picture A (between display surface 22 and planar portion 38), the appearance is as if looking down a mirrored tunnel at the picture. Nothing outside picture A is visible to the viewer, an effect which visually separates picture A from the rest of the world. Internal reflections from side surfaces 24 and 26 and from top 18 and bottom 20 are solely of picture A; picture B cannot be seen at all. The reverse occurs when looking through viewing surface 26 at picture B (between display surface 24 and planar portion 40 of backing 14). Only picture B can be seen. When looking through top 18 or bottom 20, cube 16 appears empty.

The inclusion of tabs 46 and 48 and notches 30 and 32 define a significant point of departure from pictorial displays of the prior art, which are designed to be placed on a stationary surface for viewing. However, the striking visual effect of the present invention is often best experienced when the pictorial display is picked up and rotated in one's hand. Unfortunately, none of the pictorial displays of the prior art can be picked up, rotated, or carried without the high probability of the backing separating from the transparent block or cube. In contrast to the prior art, tabs 46 and 48 and notches 30 and 32 (and alternative elements in the other embodiments described herein) allow pictorial display 10 to be picked up and rotated (even inverted) without having backing 14 accidentally separate from cube 16.

A useful function flows from the aforementioned visual separation effect of transparent cube 16: pictures selected for use in pictorial display 10 can be cropped. To illustrate, place a picture on a flat surface and lay cube 16 on top of it. When looking down through the top surface, all that can be seen of the picture is the portion lying within the perimeter of the bottom surface; the remainder of the picture is removed from vision due to the internal reflections from the vertical surfaces of cube 16. By moving cube 16 over the picture, the scene changes as a different segment of the picture is enclosed within said perimeter. The viewer can then compose the scene for greatest impact. Unnecessary, distracting background details can be excluded, while the principal points of interest can be arranged for emphasis. When the desired composition is attained, one can draw a line on the picture around the bottom edges of the cube, and trim away the excess. It is the next best thing to cropping the picture in a darkroom.

Several alternative embodiments are disclosed in FIGS. 4–10. As is apparent from comparing FIGS. 1–3 with FIGS. 4–6, FIGS. 7–8, and FIGS. 9–10, respectively, the alternate embodiments share the same general principles but differ in some structural aspects.

Figure 4:
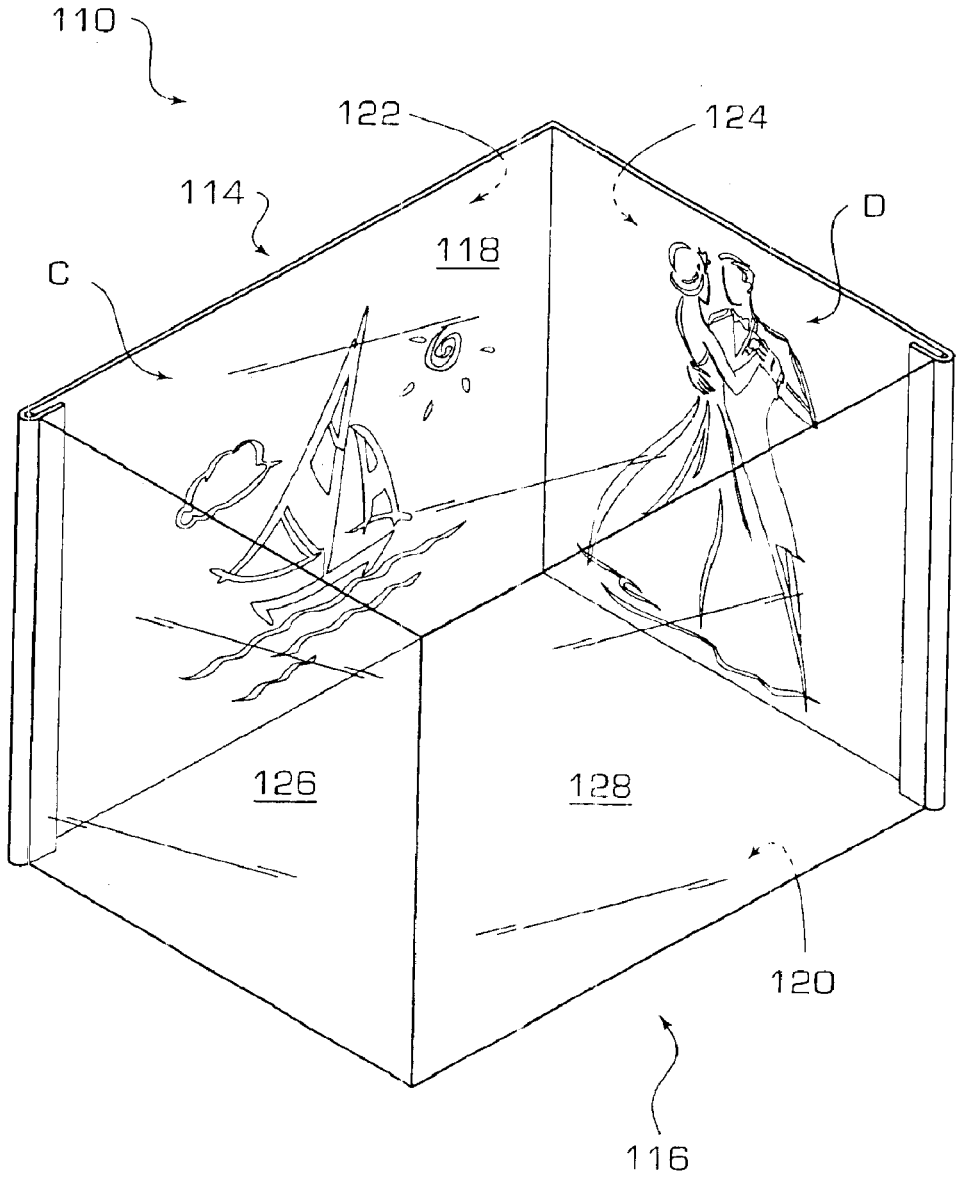
FIG. 4 is a perspective view of a second preferred embodiment of the invention shown displaying pictures C and D.
Figure 5:
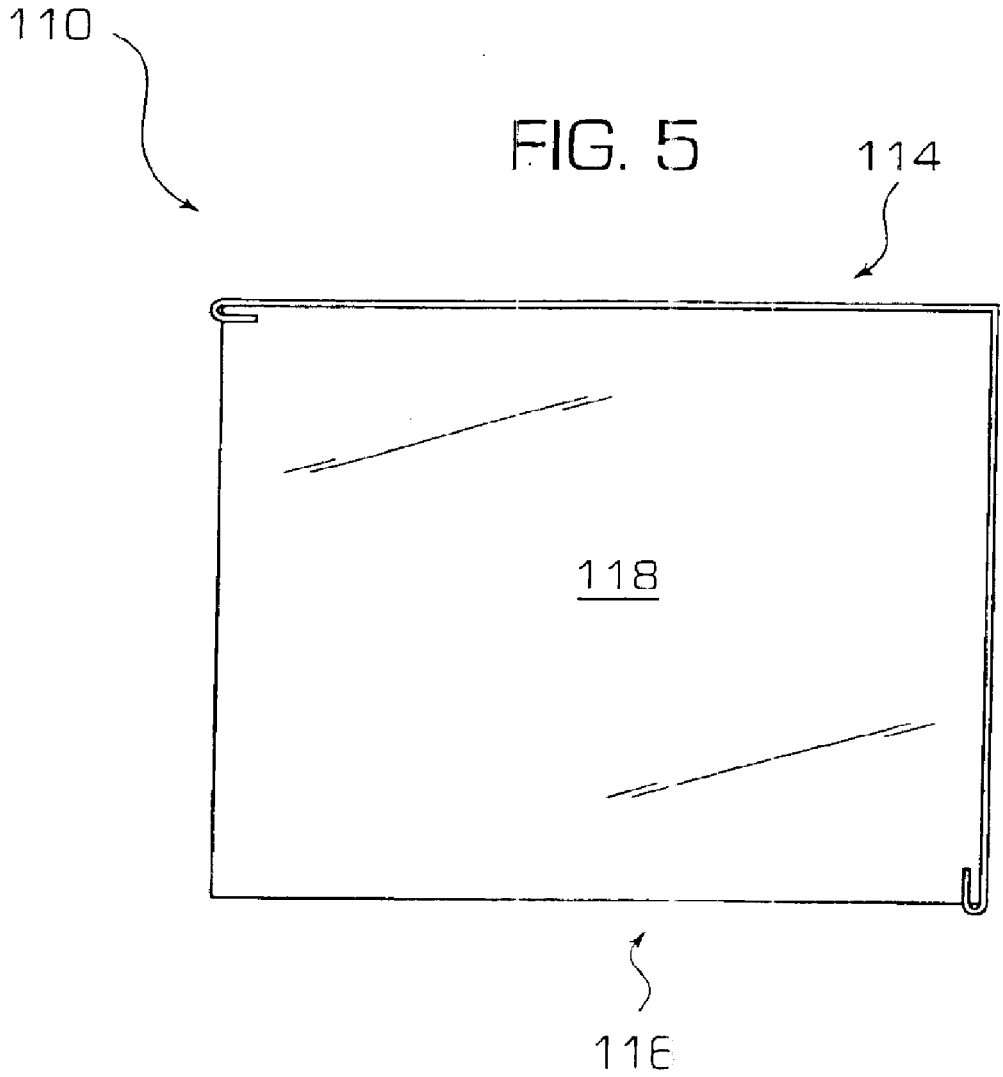
FIG. 5 is a top view of the embodiment shown in FIG. 4.
Figure 6:
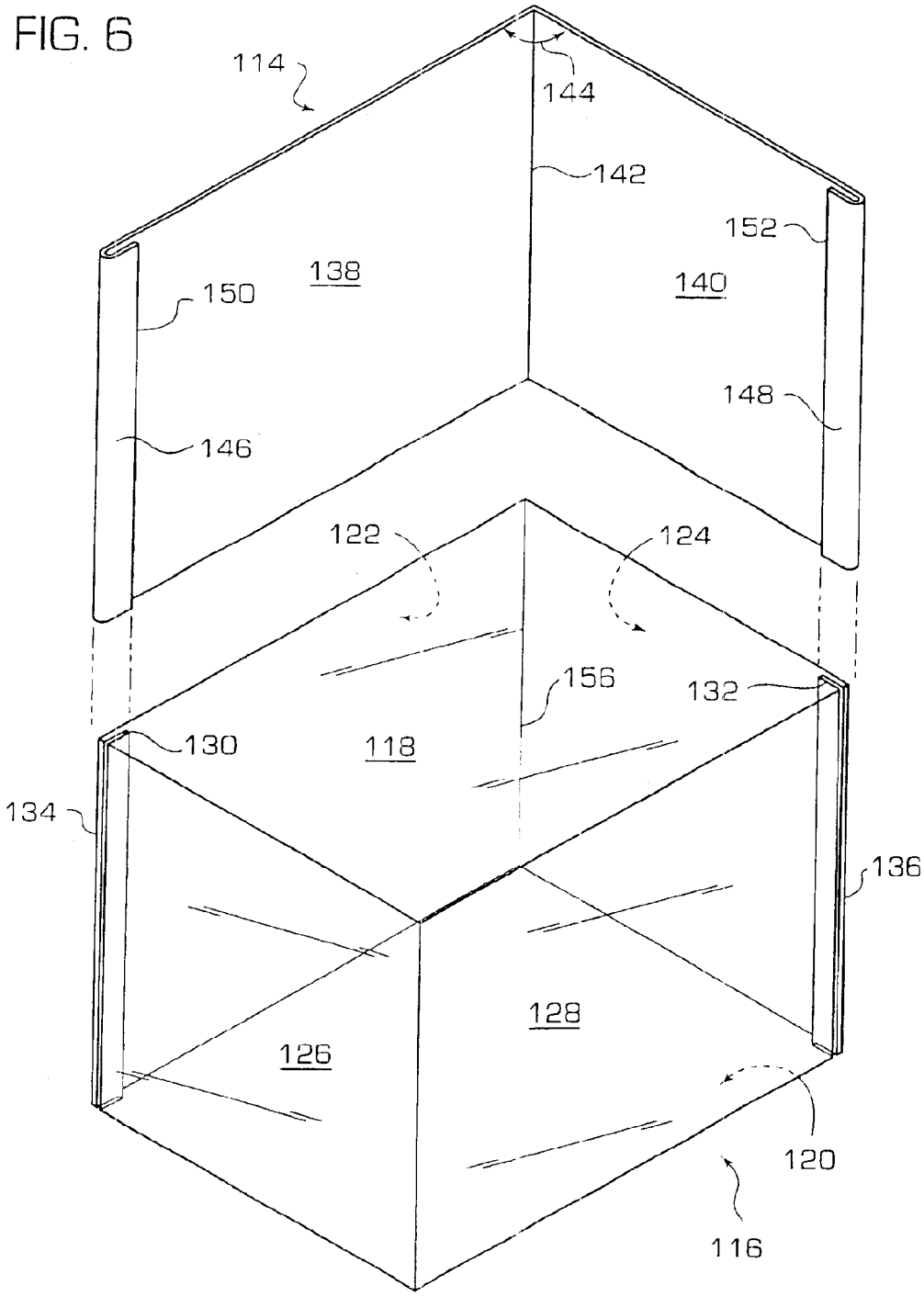
FIG. 6 is an exploded perspective view of the invention of FIG. 4.

A second embodiment is disclosed in FIGS. 4–6 where similar elements and elements having similar functions are denoted by reference numerals incremented by 100.

Pictorial display 110 differs from pictorial display 10 in the shape of block 116 and in the manner in which the backing 114 is removably attached to block 116.

Hexahedron 116 is a solid, transparent block, like cube 16, but with four of the surfaces being rectangularly shaped instead of all six surfaces being square. Display surface 124 and its viewing surface 126 are identical squares, as they are in the embodiment of FIGS. 1–3, whereas display surface 122 and its viewing surface 128 are identical rectangles. Top 118 and bottom 120 are also rectangles having the same dimensions as surfaces 122 and 128. The advantage of juxtaposing a square and a rectangle is that two differently sized pictures C and D can be displayed together. Of course, sides 124 and 126 could also be identical rectangles which differ in dimensions from rectangular sides 118, 120, 122, and 128. The invention places no restrictions on the size and shape of the surfaces of the polyhedron.

The second difference resides in the way backing 114 is attached to hexahedron 116, as most clearly shown in FIG. 6. Surface 126 has a vertical slot 130 formed adjacent and parallel to edge 134; slot 130 opens through both top 118 and bottom 120. Surface 128 has a similar slot 132 formed adjacent and parallel to edge 136. Slots 130 and 132 are spaced a selected distance from edges 134 and 136. Slots 130 and 132 replace sloping recesses 30 and 32 as attachment receptacles in hexahedron 116.

Backing 114 comprises planar portions 138 and 140, which are orthogonal to one another at 144 along a common corner 142. Planar portion 138 has the same rectangular dimensions as side 122, and planar portion 140 is identical in outline to side 124. The backing 114 includes free edges 150 and 152. The backing 114 is bent between the free edges 150 and 152 and the planar portions 138 and 140 to form flanges 146 and 148. To interlock with slots 130 and 132, the flanges 146 and 148 of backing 114 are bent 180° so that flanges 146 and 148 are parallel to planar portions 138 and 140 and spaced apart the same selected distance as slots 130 and 132 are from edges 134 and 136. Flanges 146 and 148 are friction fit within slots 130 and 132 and will remain in said slots until intentionally removed.

Referring to FIG. 6, pictorial display 110 is assembled as follows: place pictures C and D against the interior surfaces of planar portions 138 and 140. Slide block 116 onto backing 114 with flange 146 sliding within slot 130 and flange 148 sliding within slot 132. Edge 156 will nest within corner 142. Similar visual effects are obtained with the embodiment of FIGS. 4–6 as with FIGS. 1–3.

Third and fourth embodiments of the present invention are disclosed in FIGS. 7–8 and FIGS. 9–10, respectively. Elements shown in FIGS. 7–8 and FIGS. 9–10 having similar functions to elements in FIGS. 1–3 are denoted by reference numerals incremented by 200 and 300, respectively.

Figure 7:
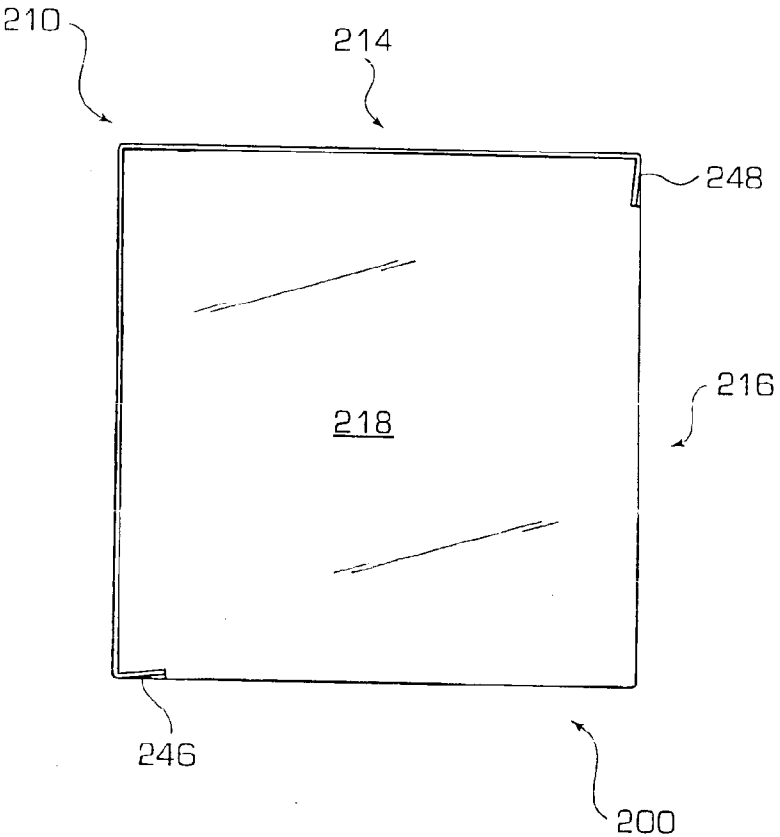
FIG. 7 is a top view of a third preferred embodiment of the invention.
Figure 8:
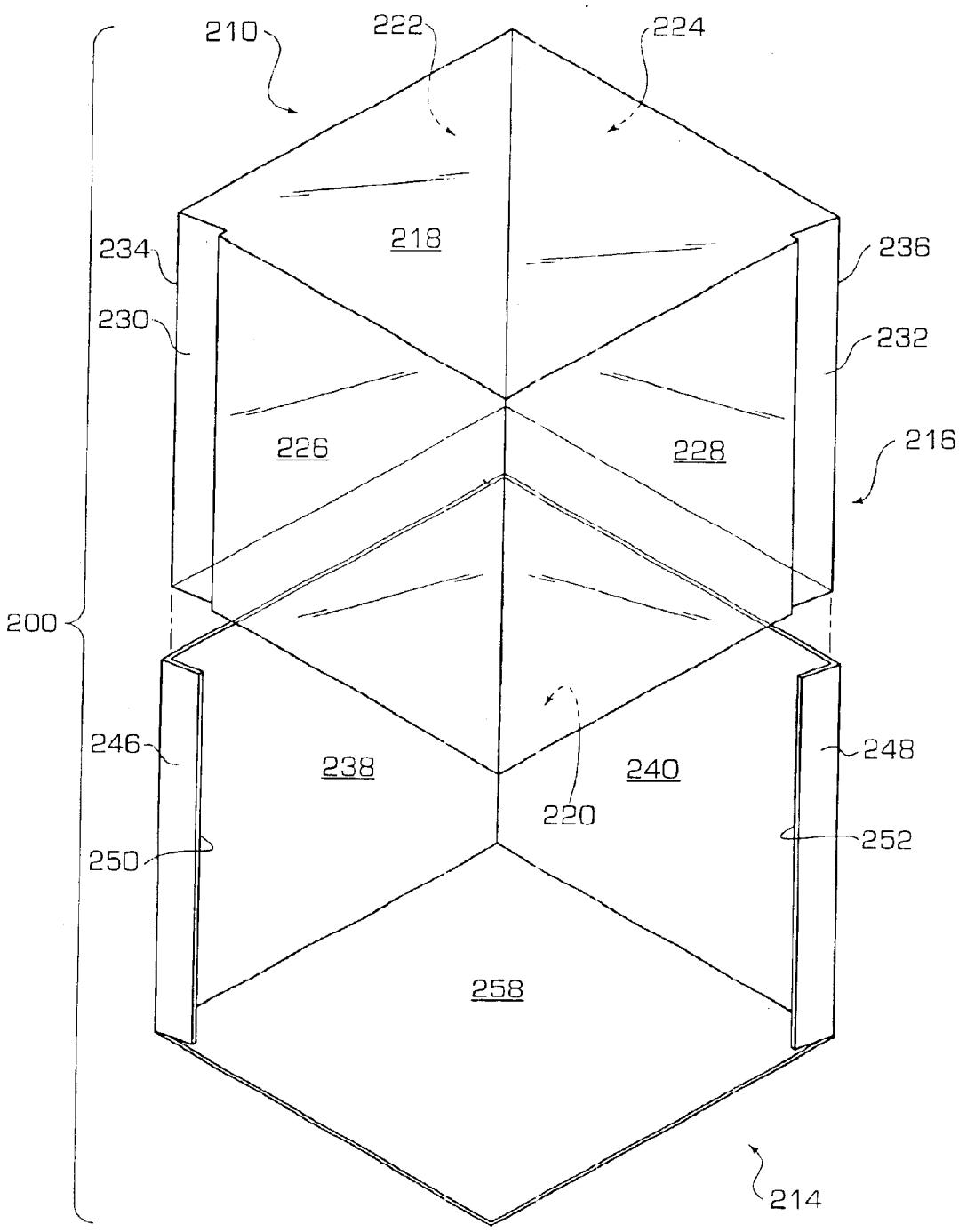
FIG. 8 is an exploded perspective view of the embodiment shown in FIG. 7.

Referring now to FIGS. 7 and 8, there are three primary differences between pictorial display 200 and pictorial display 10: the shape of flanges 246 and 248, the shape of recesses 230 and 232, and the addition of planar bottom portion 258 to backing 214.

In pictorial display 200, backing 214 includes free edges 250 and 252. Flanges 246 and 248 of backing 214 are inwardly bent planar portions 238 and 240 slightly more than 90 degrees (100 degrees, for example). Flanges 246 and 248 then form slightly acute angles with planar portions 238 and 240, respectively.

Cube 216 of pictorial display 200 includes two L-shaped recesses 230 and 232 which each extend inwardly from edges 234 and 236, respectively, and from top 218 to bottom 220. Recesses 230 and 232 are angled to match the angle of flanges 246 and 248, respectively.

Backing 214 of pictorial display 200 includes a planar bottom surface 258, which is identical in outline to bottom 220, and serves as a third picture viewing surface.

As shown in FIG. 8, pictorial display 200 is assembled by aligning flanges 246 and 248 with recesses 230 and 232 and sliding cube 216 downwardly into backing 214. As with the second embodiment, flanges 246 and 248 are biased to provide a friction fit against recesses 230 and 232, respectively. The friction fit, as well as the inclusion of planar bottom surface 258, secure cube 216 to backing 214. In this embodiment, flanges 246 and 248 and recesses 230 and 232 cooperate to more securely attach backing 214 to cube 216 than similar structure in the embodiment shown in FIGS. 1–3, and allows the present invention to be manufactured to less exacting tolerances than the flange and slot combinations of the other embodiments disclosed herein, while still providing a secure, attractive fit between cube 216 and backing 214. Also, the addition of bottom surface 258 provides both an additional picture viewing surface and greater structural rigidity to backing 214.

Figure 9:
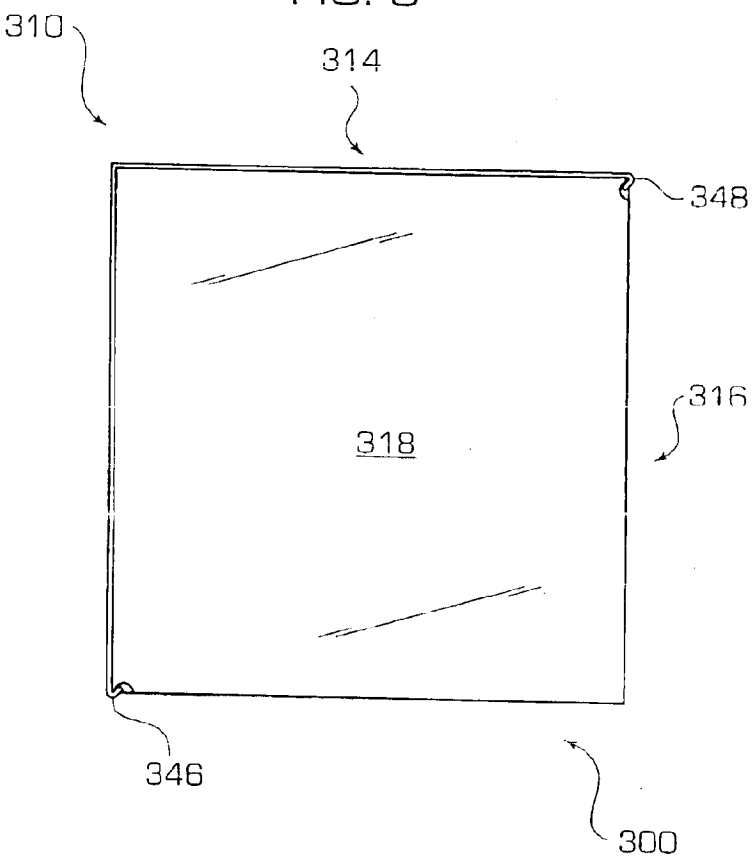
FIG. 9 is a top view of a fourth preferred embodiment of the invention.
Figure 10:
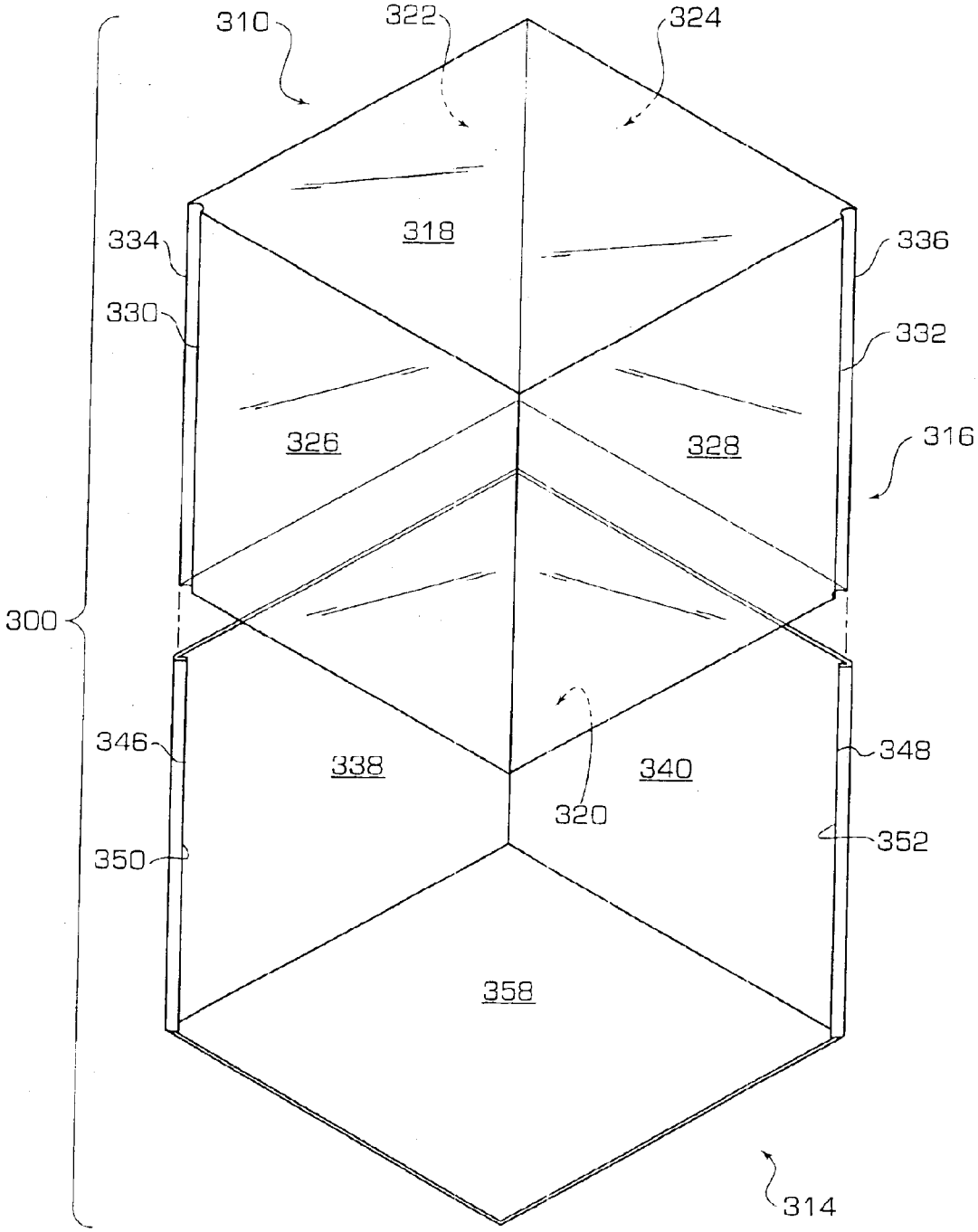
FIG. 10 is an exploded perspective view of the embodiment shown in FIG. 9.

Referring now to FIGS. 9 and 10, pictorial display 300 comprises a fourth embodiment of the present invention. Pictorial display 300 is nearly identical to pictorial display 200, except in the shape of flanges 346 and 348 and recesses 330 and 332.

In pictorial display 300, recesses 330 and 332 are each arcuate in cross-section (e.g., each forming a half-cylinder). Flanges 346 and 348 are narrower than flanges 246 and 248 and flanges 346 and 348 are bent and form much smaller angles with planar surfaces 338 and 340, respectively. When pictorial display 300 is assembled, edges 350 and 352 are biased to contact cube 316 roughly in the middle of recesses 330 and 332, respectively. This configuration allows flanges 346 and 348 and recesses 330 and 332 to be manufactured to less exacting tolerances than the flange and recess combinations of the other embodiments disclosed herein, while still providing a secure, attractive fit between cube 316 and backing 314.

The design of flanges 346 and 348 and recesses 330 and 332 also represents an improvement over the other disclosed embodiments in that it maximizes visibility of planar surfaces 338 and 340, while effectively securing cube 316 to backing 314.

Those skilled in the art will appreciate that the conceptions upon which this disclosure is based may readily be utilized as a basis for the designing of other structures and systems for carrying out the several purposes of the present invention. For instance, it is within the purview of the invention to shape a solid, transparent block in the form of a polyhedron having a different number of sides than the previously disclosed six of a cube and a hexahedron. Attachment of the backing and block is effected by the coaction of appropriately designed receptacles formed in the appropriate surfaces of the polyhedron with complementary attachment tabs on a backing, with the backing being suitably bent to conform to the number of side surfaces it is designed to cover. Also, although the backing has been disclosed herein as covering two or three adjacent surfaces, it is contemplated that, one or more than three display surfaces may be backed by an opaque material. And, the interlocking tab/recess elements can be reversed. That is, attachment tabs can be molded onto selected polyhedron surfaces and recesses or apertures can be stamped into the backing during manufacture. Finally, "interlocking elements" is considered a generic term which includes all types of flanges or tabs that are used to secure the backing to the polyhedron. It is important, therefore, that the claims be regarded as including such equivalent constructions insofar as they do not depart from the spirit and scope of the present invention as defined in the appended claims.

The purpose of the Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is it intended to be limiting as to the scope of the invention in any way.

It can be seen from the above that an invention has been disclosed which fulfills all the objects of the invention. It is to be understood, however, that the disclosure is by way of illustration only and that the scope of the invention is to be limited solely by the following claims:

I claim as my invention:

1. A pictorial display, comprising:

a polyhedron formed of a transparent material and having a top, a bottom, a pair of angularly offset viewing surfaces, and a pair of angularly offset display surfaces, said viewing and extending between said top and said bottom, said viewing surfaces respectively including first and second recesses; and a backing comprising first and second flanges, first and second free edges, and first and second planar portions, each of said first and second planar portions being shaped and located to substantially respectively cover said pair of angularly offset display surfaces, said first flange being located between said first free edge and said first planar portion and said second flange being located between said second free edge and said second planar portion;

wherein said backing and said polyhedron are adapted to receive a pictorial representation therebetween for viewing through said viewing surfaces of said polyhedron;

wherein said first edge is received within said first recess and said second edge is received within said second recess to removably attach said backing to said polyhedron such that said first and second planar portions cover said pair of display surfaces;

wherein said first flange is bent inwardly such that a first angle of less than 90 degrees is formed by said first flange and said first planar portion and said second flange is bent inwardly such that a second angle of less than 90 degrees is formed by said second flange and said second planar portion.

2. The pictorial display of claim 1, wherein said polyhedron includes at least one planar side, and said first and second recesses and said first and second flanges co-operate to hold said first portion of said backing in close parallel relationship with said at least one planar side of said polyhedron.

3. The pictorial display of claim 2, wherein said at least one planar side includes first and second planar sides and the dimensions of said first and second portions of said backing conform to the dimensions of each of said first and second planar sides, respectively, of said polyhedron.

4. The pictorial display of claim 1, wherein both of said pair of viewing surfaces are square.

5. The pictorial display of claim 4, wherein said polyhedron is a hexahedron.

6. The pictorial display of claim 4, wherein said polyhedron is a cube.

7. The pictorial display of claim 1, wherein one of said viewing surfaces is a square and one of said display surfaces is a rectangle.

8. The pictorial display of claim 7, wherein said polyhedron is a hexahedron.

9. The pictorial display of claim 1, wherein said backing is opaque.

10. The pictorial display of claim 1, wherein said first and second flanges each comprise a D-shaped tab.

11. The pictorial display of claim 10, wherein each of said first and second recesses comprises a sloped, D-shaped recess.

12. The pictorial display of claim 11, wherein said first and second flanges and said first and second recesses are located midway between said top and said bottom of said polyhedron.

13. The pictorial display of claim 1, wherein said first and second flanges are bent inwardly so that said first and second flanges are generally parallel to said first and second planar portions, respectively.

14. The pictorial display of claim 13, wherein each of said first and second recesses comprises a slot shaped and positioned to accommodate a substantial part of one of said first and second flanges therein.

15. The pictorial display of claim 14, wherein each of said slots extends from said top to said bottom of said polyhedron.

16. The pictorial display of claim 1, wherein each of said first and second recesses is L-shaped.

17. The pictorial display of claim 16, wherein each of said first and second recesses extends from said top of said polyhedron to said bottom of said polyhedron.

18. The pictorial display of claim 1, wherein each of said first and second flanges is substantially planar.

19. The pictorial display of claim 1, wherein each of said first and second recesses is arcuate in shape.

20. The pictorial display of claim 19, wherein each of said first and second recesses extends from said top of said polyhedron to said bottom of said polyhedron.

21. The pictorial display of claim 19, wherein said first and second flanges are biased to fit snugly within said first and second recesses, respectively.

22. The pictorial display of claim 21, wherein said bottom of said polyhedron is substantially flat and said backing further comprises a third planar portion being shaped and located to substantially cover said bottom of said polyhedron.

23. The pictorial display of claim 1, wherein said bottom of said polyhedron is substantially flat and said backing further comprises a third planar portion being shaped and located to substantially cover said bottom of said polyhedron.

24. A pictorial display comprising:

a polyhedron having a top, a bottom, and first, second, third and fourth sides, said bottom and first and second sides being substantially flat, said third and fourth sides respectively including first and second elongated slots; and a backing comprising an opaque material and having first and second flanges, first and second free edges, and first, second and third planar portions;

wherein said backing and said polyhedron are adapted to contain a pictorial representation therebetween;

wherein each of said first, second and third planar portions is shaped and located to respectively cover said first and second sides and said bottom;

wherein said first and second flanges are respectively located between said first free edge and said first planar portion and between said second free edge and said second planar portion;

wherein said first and second flanges form an acute angle with said first and second planar portions, respectively.

25. The pictorial display of claim 24, wherein each of said first and second elongated slots is arcuate in cross-section.

26. The pictorial display of claim 25, wherein said first flange and said second flange are biased to fit snugly within a respective one of said first and second elongated slots.

27. A pictorial display, comprising:

a polyhedron formed of a transparent material and having a top, a bottom, first and second display surfaces angularly offset and sharing a common corner and first and second angularly offset viewing surfaces, said viewing and display surfaces extending between said top and said bottom; and a backing including first and second flanges and first and second planar portions, said backing being bent between said first and second planar portions to form a corner which mates with said common corner of said polyhedron, said first and second planar portions being shaped and located to substantially respectively cover said first and second display surfaces, said backing being bent between said first planar portion and said first flange to form a first angle between said first flange and said first planar portion, said first flange contacting a portion of said first viewing surface, and said backing being bent between said second planar portion and said second flange to form a second angle between said second flange and said second planar portion, said second flange contacting a portion of said second viewing surface;

wherein said backing and said polyhedron are adapted to receive a pictorial representation therebetween for viewing through said first and second viewing surfaces of said polyhedron;

wherein said first and second flanges removably attach said backing to said polyhedron.

28. The pictorial display of claim 27, wherein said display and viewing surfaces are square.

29. The pictorial display of claim 27, wherein said polyhedron is a cube.

30. The pictorial display of claim 27, wherein said backing is opaque.

31. The pictorial display of claim 27, wherein said backing further comprises a third planar portion being shaped and located to substantially cover said bottom of said polyhedron.

32. The pictorial display of claim 27, wherein the polyhedron is attached to said backing by sliding said polyhedron into said backing.

* * * * *

UNITED STATES PATENT AND TRADEMARK OFFICE

CERTIFICATE OF CORRECTION

PATENT NO. : 6,845,584 B2
DATED : January 25, 2005
INVENTOR(S) : Thomas Vincent

It is certified that error appears in the above-identified patent and that said Letters Patent is hereby corrected as shown below:

Column 7,
Lines 48-54, please delete
"I claim as my invention:
1. A pictorial display, comprising:
a polyhedron formed of a transparent material and having a top, a bottom, a pair of angularly offset viewing surfaces, and a pair of angularly offset display surfaces, said viewing and extending between said top and said bottom, said viewing surfaces respectively including first and second recesses; and" and add:
-- I claim as my invention:
1. A pictorial display, comprising:
a polyhedron formed of a transparent material and having a top, a bottom, a pair of angularly offset viewing surfaces, and a pair of angulary offset display surfaces, said viewing and display surfaces, extending between said top and said bottom, said viewing surfaces respectively including first and second recesses; and --.

Signed and Sealed this

Twenty-third Day of August, 2005

JON W. DUDAS
*Director of the United States Patent and Trademark Office*